US007686634B2

(12) United States Patent
Trimborn et al.

(10) Patent No.: US 7,686,634 B2
(45) Date of Patent: Mar. 30, 2010

(54) CHARGING CONNECTOR

(75) Inventors: Jens Trimborn, Wuppertal (DE); Thomas Koch, Northeim (DE); Wolfgang Stahl, Halstenbeck (DE); Peter Auner, München (DE)

(73) Assignee: Schaltbau GmbH, München (DE)

( * ) Notice: Subject to any disclaimer, the term of this patent is extended or adjusted under 35 U.S.C. 154(b) by 0 days.

(21) Appl. No.: 11/994,900

(22) PCT Filed: Jul. 5, 2006

(86) PCT No.: PCT/EP2006/006563

§ 371 (c)(1),
(2), (4) Date: Jun. 26, 2008

(87) PCT Pub. No.: WO2007/017023

PCT Pub. Date: Feb. 15, 2007

(65) Prior Publication Data

US 2009/0149077 A1 Jun. 11, 2009

(30) Foreign Application Priority Data

Aug. 10, 2005 (DE) ..... 10 2005 037 864

(51) Int. Cl.
*H01R 4/60* (2006.01)

(52) U.S. Cl. ..... 439/191

(58) Field of Classification Search ..... 439/190–195, 439/198–204
See application file for complete search history.

(56) References Cited

U.S. PATENT DOCUMENTS

2008/0318477 A1* 12/2008 Standke ..... 439/620.01
2009/0149077 A1* 6/2009 Trimborn et al. ..... 439/660

FOREIGN PATENT DOCUMENTS

| | | |
|---|---|---|
| DE | 90 16 595 | 5/1992 |
| DE | 203 18 583 U1 | 3/2005 |
| EP | 0 821 444 A2 | 1/1998 |
| EP | 1 538 708 A2 | 6/2005 |

* cited by examiner

*Primary Examiner*—Ross N Gushi
(74) *Attorney, Agent, or Firm*—Finnegan, Henderson, Farabow, Garrett & Dunner, L.L.P.

(57) ABSTRACT

The invention relates to a charging connector, comprising a plug provided with a plug housing and a socket outlet provided with a socket outlet housing, wherein the plug housing and the socket outlet housing each comprise standard fixing holes for fixing a handle in an interchangeable manner, wherein the charging connector is additionally provided with interchangeable adapters for fluid lines and/or pilot contacts, wherein the adapters are arranged on the interchangeable handles and can be fixed therewith to the charging plug housing and/or socket outlet housing.

11 Claims, 6 Drawing Sheets

CHARGING CONNECTOR

BACKGROUND OF THE INVENTION

The present invention relates to a charging connector comprising a plug provided with a plug housing and a socket outlet provided with a socket outlet housing. Corresponding charging connectors serve, for example, the transfer of electric currents and media, e.g. for a forklift truck.

Various charging connectors are already known, which are not only provided with a plug and socket device for the transfer of electric power and voltage, but simultaneously with a plug and socket device for a media transport system. Upon plugging the individual plug and socket devices upon one another also a connection between the battery and the charging station for the media transport system is produced simultaneously with the electrical connection between the battery and the charging station, so as to simultaneously allow, for example, during the charging process on the battery, a media coupling for the transfer of liquid and gaseous media. At the same time, compressed air from a compressed air supply unit can be supplied to the battery via the coupled compressed air supplies of the plug and socket devices.

A charging connector kit including an adapter is known from DE 203 18 583, in which pilot contacts or also fluids can be passed.

The charging connector kit as disclosed comprises a plug housing, which is plugged into a socket outlet housing. The socket outlet housing includes an apron with two pin contacts received in two corresponding pin contact receiving recesses inside the plug-in projection of the plug housing. Coding pins and coding pin receiving recesses formed in both the apron and the plug-in projection ensure that a corresponding plug can only be plugged into the respective socket outlet. Moreover, an adapter can detachably be plugged into the housing in the longitudinal direction, both in the region of the apron and the region of the plug-in projection. This adapter can be inserted in a mutually mating manner on the plug to face the socket and on the socket to face the plug, in the form of a plug-in adapter or receiving adapter, in the longitudinal direction of the plug and the socket outlet. In each adapter a fluid main channel and fluid branch channels ending in the same are extending in such a way that the ends of the fluid branch channels located on the outside of the plug-in adapter are embodied as hollow plug-in projections which are introduced into the fluid branch channels of the receiving adapter to produce a fluid-tight connection in the plugged-in state of the plug and the socket. By this, an easy removability of the fluid/air contact elements is achieved, and it also allows an easier repair or an exchange of these fluid/air contacts against additional pilot contacts.

A charging connector is known from DE 90 16 595, wherein the layout of the fluid lines and fluid coupling is provided on the outside of the appliance plug and appliance socket outlet, that is, on housing cover plates each fixable on the corresponding halves of the housing. Moreover, a holder is provided, by means of which the connecting point to the fluid sleeves and the fluid pins plugged into these sleeves can be defined in a mutually detachable manner.

It is the object of the present invention to provide a charging connector usable in particularly versatile ways, both in cases where merely an electrical interconnection is needed or in cases which require at least one additional fluid/air transport system. At the same time, the charging connector is to have a simple structure and should be manufacturable at low costs.

SUMMARY OF THE INVENTION

The object is achieved with a charging connector comprising a plug provided with a plug housing and a socket outlet provided with a socket outlet housing, wherein the plug housing and the socket outlet housing each comprise standard fixing holes for fixing a handle, wherein the charging connector is additionally provided with interchangeable adapters for fluid lines and/or pilot contacts and wherein the adapters are arranged on the interchangeable handles and can be fixed therewith to the charging plug housing and/or socket outlet housing. The fluids contain, among others, air, battery acid, water etc.

The present invention allows the connection of any commercial charging connector to adapters without any problems, so that it not only serves as an electric supply, but is simultaneously also provided with one or more fluid or compressed air transport system(s), whereby a fluid coupling is produced by the adapters to transfer liquid and gaseous media. Furthermore, the fluid coupling is closable as an air module and as a water module and can additionally be employed as degassing module. The conventionally used, standard handle is thereby adapted such that the portions encompassing the housing are provided with fixing elements for the adapter housings. The present embodiment consequently makes it possible to provide a charging connector with adapters or not, depending on the choice of the handle. Also, the position of the adapters can be varied in accordance with the selection of the corresponding handle. As the elements are standard ones, a corresponding handle provided with an adapter can be disposed on conventionally available charging connectors. Correspondingly equipped charging connectors are accordingly universally usable, so that the number of the necessary charging connectors can be reduced.

According to a preferred embodiment it may be provided that each adapter is received in an adapter housing to which the adapter is detachably connectable. As the adapter is not directly connected to the handle, the maintenance and a possible exchange of the adapters is considerably simplified, while the adapter can be easily replaced by pilot contacts without involving lengthy modification times. Moreover, it is possible to continue to use the already existing adapters.

Advantageously, the adapter housing can be locked into place on the handle. This considerably simplifies the assembly and the exchange of the adapters.

According to another preferred embodiment the handle associated to the plug housing as well as the handle associated to the socket outlet housing may be provided with at least one adapter housing.

The adapter housing may advantageously be embodied to have two parts, wherein one part is associated to the plug housing and one part to the socket outlet housing.

This feature, too, contributes to the two-part embodiment of the charging connector. Simultaneously with the connection of the socket outlet and the plug also the respectively associated adapter housing parts are connected to each other.

According to a further preferred embodiment it may be provided that each adapter housing comprises a receiving portion or a plug-in portion, wherein an adapter housing comprising a plug-in portion is associated to an adapter housing comprising a receiving portion. This ensures a particularly reliable connection of the adapters since not only the adapter, but also the adapter housing is secured by a real plug and socket type connection.

Advantageously, the adapter housing may be embodied to have a substantially rectangular cross-section. In practical operation this shape has proved to be particularly convenient.

According to another preferred embodiment it may be provided that at least two adapter housings are arranged on one another. Again, this embodiment increases the possibilities of varying the charging connectors because different adapters or pilot contacts can thus be arranged on the charging connector simultaneously.

Advantageously, snap-in elements may be formed on the outer topside and/or the outer bottom side of the adapter housing. Corresponding snap-in elements allow a problem-free stacking of the adapter housings on one another. Corresponding snap-in elements can, however, also be used to secure the adapter housing to the handle.

According to a preferred embodiment each outer top surface of an adapter housing portion may be embodied with a snap-in nose and a snap-in cavity formed on the opposite ends. The connection by means of the snap-in nose and the snap-in cavity allows a secure connection, wherein the individual housings are connectable to and separable from each other without any problems.

Advantageously, the bottom side of the housing of each adapter can comprise a recess in which a fixing strap of an adapter or of the handle can be received.

BRIEF DESCRIPTION OF THE DRAWINGS

Exemplary embodiments of the present invention will be explained in more detail below by means of a drawing. In the drawing.

DETAILED DESCRIPTION OF THE INVENTION

Figure 1:
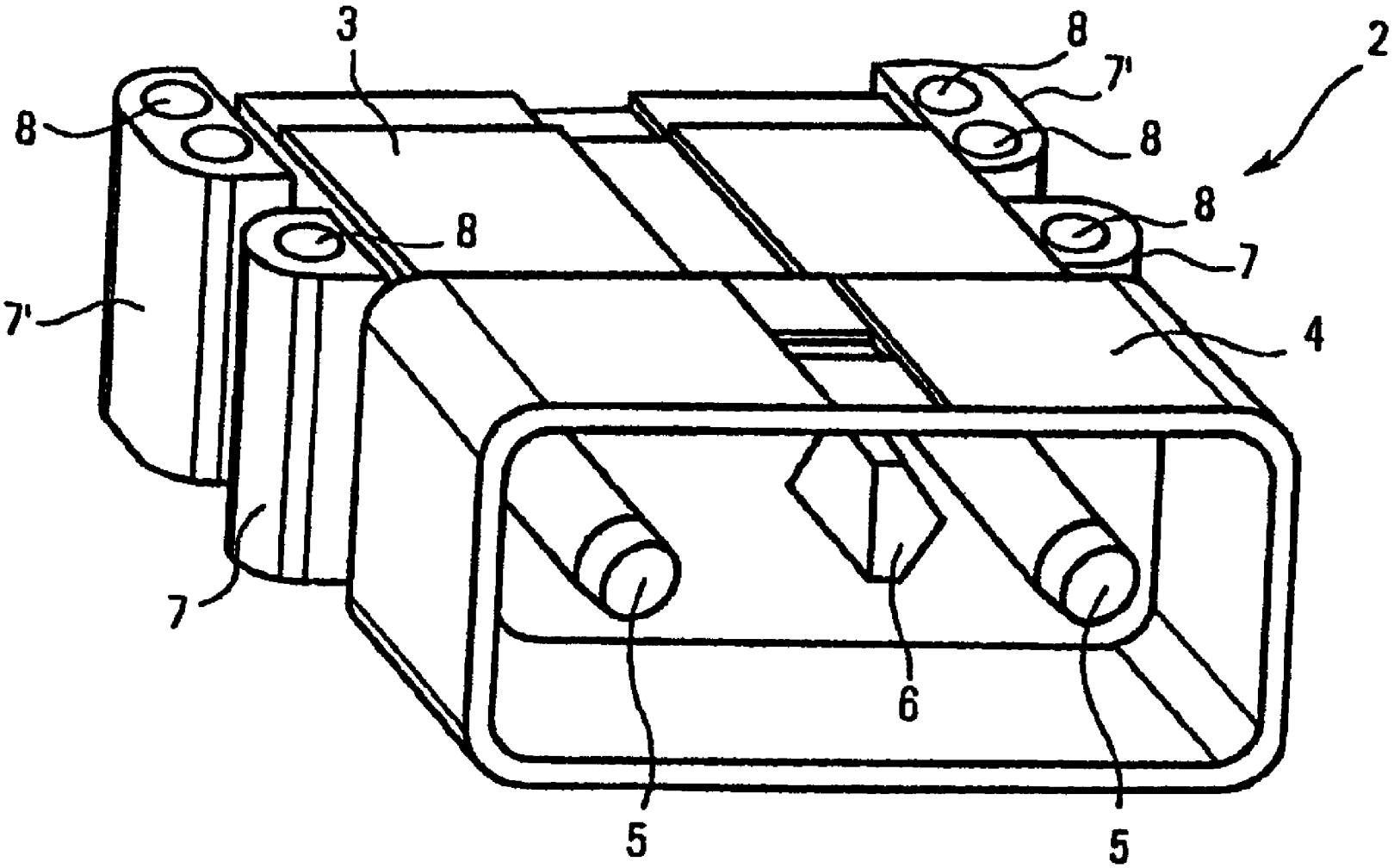
FIG. 1 shows a socket outlet with a socket outlet housing in a perspective view of the charging connector according to the invention.
Figure 2:
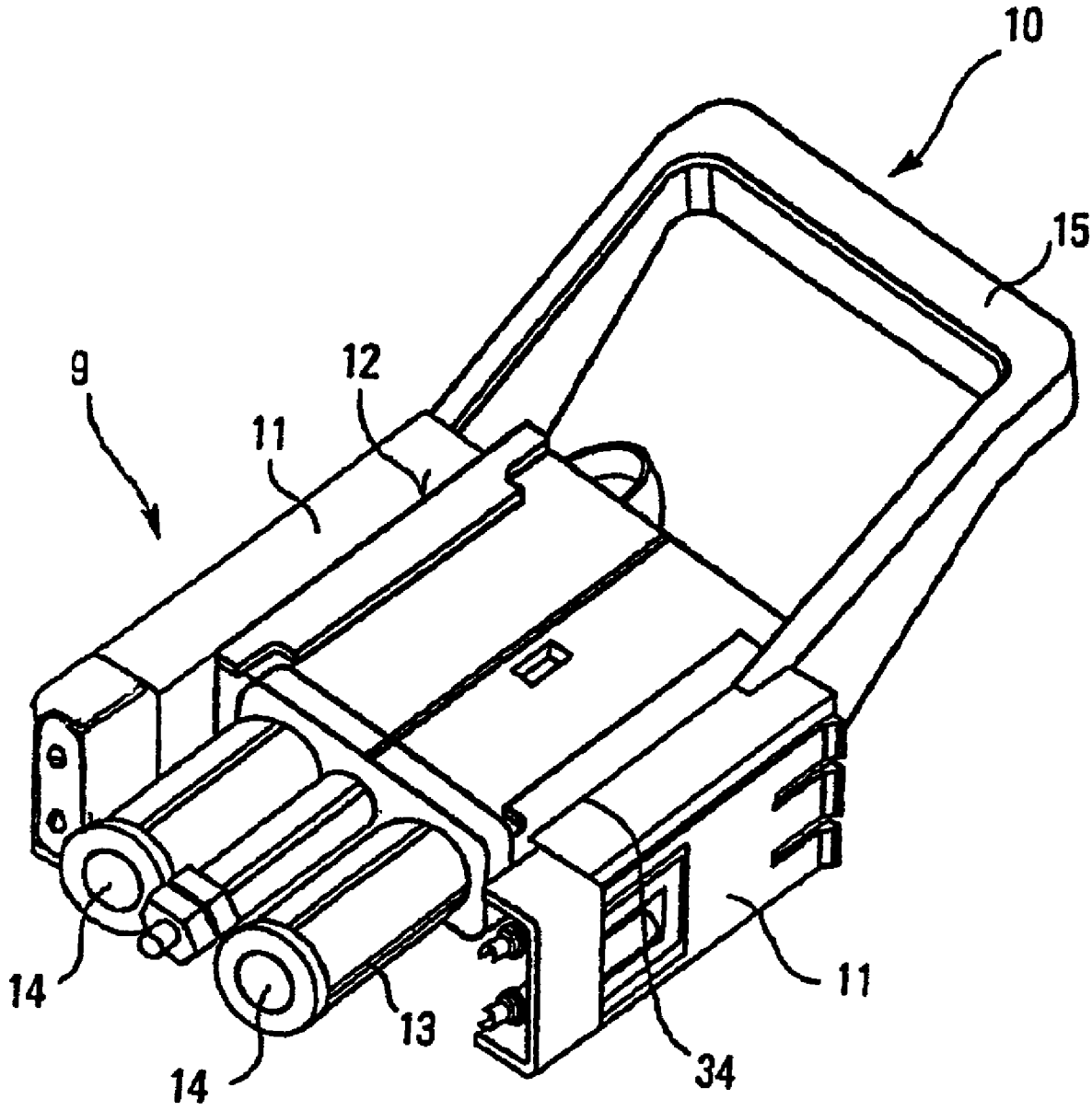
FIG. 2 shows a perspective view of the plug housing from the top, with a handle fixed to the plug housing and with adapter housings arranged on the side of the handle.

FIGS. 1 and 2 each show the two individual parts of the charging connector, namely the socket outlet and the plug.

The socket outlet 2 comprises a socket outlet housing 3 on the one end of which an apron 4 is located. This apron 4 surrounds two current-carrying contacts 5 and one coding pin 6 arranged between the pin contacts 5.

Laterally of the housing fixing means 7, 7' are arranged on both sides, by means of which the plug housing can be connected to a handle. The fixing means 7, 7' comprise fixing holes 8 which extend vertically with respect to the outer top surface of the housing. The arrangement of the fixing holes is thereby standardized for charging connectors of this type. The fixing means 7, 7' are formed on the lateral outer surfaces of the socket outlet housing in such a way that two individual fixing means are arranged at a predefined distance from each other, wherein the fixing means facing the apron is provided with one fixing hole 8, while the fixing means arranged at the end facing away from the apron is provided with two fixing holes. The individual fixing means 7, 7' do not extend over the lateral outer surface completely, but keep a predefined distance with respect to the outer top surface and the outer bottom surface.

FIG. 2 shows the plug of the charging connector 1 according to the invention, wherein the plug 9 is, on the one hand, already provided with a handle 10 as well as with adapter housings 11 each arranged laterally of the handle 10.

In detail, plug 9 comprises a plug housing 12, wherein a part of the plug housing 12 is embodied as plug-in projection 13. In the plug-in projection 13 pin contact receiving recesses 14 are provided parallel to the longitudinal axis of the plug 9. Moreover, a coding pin is arranged in a coding pin receptacle between the pin contact receiving recesses.

In the assembled state of the plug and the socket outlet, the pin contacts 5 as well as the coding pin 6 of the socket outlet are inserted into the pin contact receiving recesses 14 and the coding pin receptacle of the plug.

A handle 10 for allowing the better handling of the plug is disposed on the outsides of the housing 12. To this end, also the plug housing 12 is provided with fixing means, which are embodied in correspondence with the fixing means 7, 7' of the socket outlet housing. The handle is provided with fixing portions 34 formed in the area of the housing, which are each substantially U-shaped, with the base portion extending parallel to the lateral outer surfaces of the housing 12 and the U-shaped legs extending parallel to the outer top surface or outer bottom surface, respectively. The U-shaped legs thereby extend to a predefined extent beyond the fixing means until above the outer top surface or outer bottom surface, respectively, of the housing 12. A holding element 15 extends from the fixing portion 34, which is arranged to be offset slightly inclined with respect to the housing.

Two adapter housings 11 can be arranged on the outer surface of the fixing portion 34. In the illustrated embodiment, the adapter housings are arranged on the sides, i.e. they are fixed to the outer surface of the U-base of the fixing portion.

Figure 3:
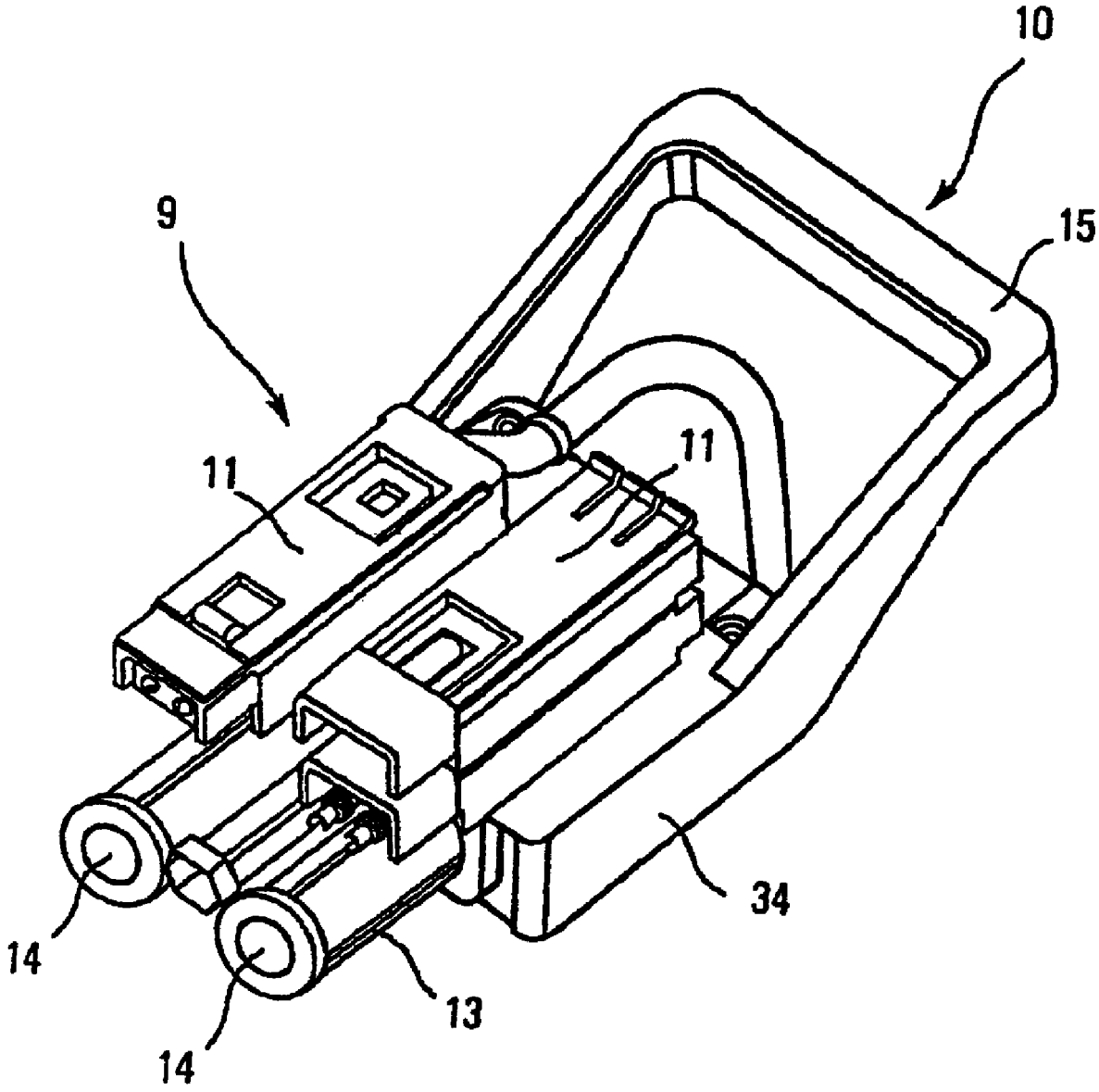
FIG. 3 shows a perspective view onto a plug housing with a handle and adapter housings associated to the topside of the plug housing.

FIG. 3 shows a corresponding plug housing, wherein the adapter housings 11 are associated to the outer top surface of the plug housing 12, that is, the adapter housings are in this case arranged on the two opposite U-shaped legs of the fixing portion. Adapters may be inserted into the adapter housings 11 so as to provide an additional fluid/air transport, which is simultaneously produced as the device socket outlet and the device plug are plugged together. In the present case, the two adapter housings being directly adjacent to each other comprise adapters inserted into the same.

It can moreover be seen in FIG. 3 that the present embodiment allows a plurality of possible additional plug-in elements, as the adapter housings 11 are embodied in such a way that also two or more adapters can be stacked onto one another. The structure of the adapter housing will be explained below.

As the adapter housings can be arranged on the handle in an optional manner, the present invention represents a possibility to vary any ordinary charging connector with standard fixing holes 8 for the most various cases of use by attaching the handles 10 provided with adapter housings 11.

Figure 4:
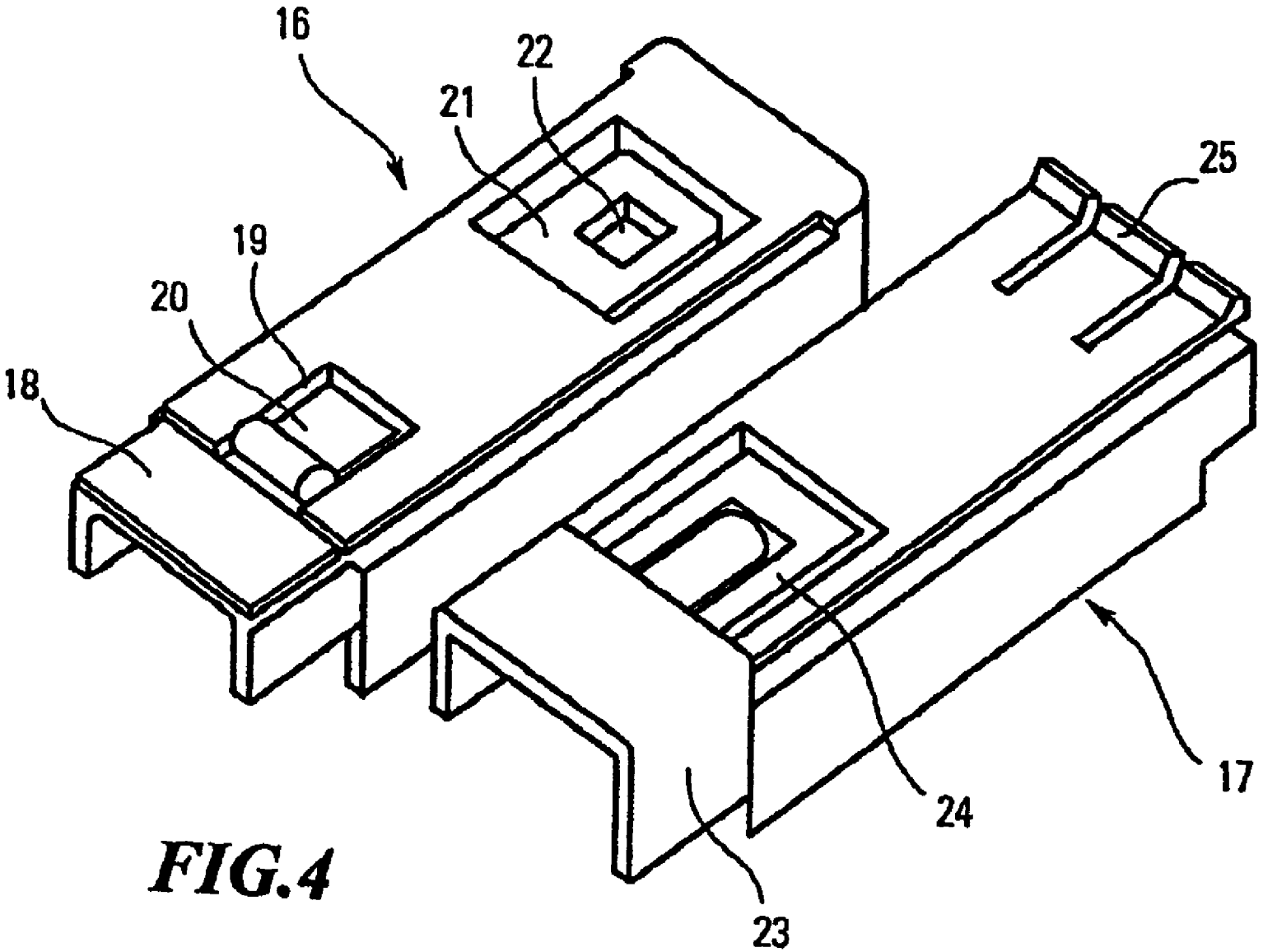
FIG. 4 shows a perspective view onto two adapter housings.

FIG. 4 shows two adaptor housings 11. It can be seen that the adapter housing, too, is embodied as plug-in adapter housing 16 and as receiving adapter housing 17. In use, a plug-in adapter housing or a receiving adapter housing is arranged in a mutually mating manner on the plug to face the socket outlet and on the socket outlet to face the plug in the longitudinal direction of the plug and the socket outlet.

The plug-in adapter housing 16 is formed as a longitudinal housing having a substantially rectangular cross-section. On one end, the housing is provided with a plug-in projection 18 which is formed as a U-shaped section, with the U-base element extending substantially parallel to the top surface of the adapter housing 16. The U-shaped legs as well as the U-base are thereby arranged to be offset inwardly with respect to the outer top surfaces. Moreover, two snap-in sections 19, 20 are arranged on the outer top surface of the adapter housing 16, wherein the snap-in section 19 directly joins the plug-in projection 18. The snap-in section 19 is formed as a substantially quadrangular recess, wherein, in the outer top surface of the housing, this recess is integrally provided with a snap-in nose 21 extending from the side facing away from the plug-in projection 18 toward the plug-in projection 18 and having an elevation on the end facing the plug-in projection 18. Merely the elevation of the snap-in nose 21 is disposed above the outer top surface of the housing 11, whereas the rest of the snap-in nose is slightly underneath the outer top surface.

The snap-in section 21 is formed as a snap-in cavity, which is also substantially quadrangular and is arranged underneath the outer top surface. Approximately in the middle within the snap-in cavity a substantially quadrangular snap-in receptacle 22 is formed.

The receiving adapter housing 17 has substantially the same dimensions as the plug-in adapter housing 16, wherein one end, i.e., in use, the end opposite the socket outlet or the plug, respectively, is connected to a receiving portion 23, however. The receiving portion 23 has a substantially U-shaped cross-section, wherein the U-shaped legs and the U-base, respectively, extend parallel to the side walls and the outer top surface of the adapter housing. The individual portions of the receiving portion are here embodied parallel to the respective surfaces of the housing, however, with a greater outer diameter. In use, the receiving portion 23 of the housing adapter 17 receives the plug-in projection 18 of the opposite plug-in adapter housing 16. This ensures a secure connection between the two housings. The receiving adapter housing 17, too, is provided with snap-in sections 24 and 25 on its outer top surface, whereby the snap-in section 24 directly joining the receiving portion 23 is formed as a snap-in cavity, which is provided with a snap-in receptacle in approximately the middle thereof.

At the end of the receiving adapter housing 17 opposite the receiving portion 23 a snap-in nose section 25 is formed, whereby the snap-in nose is, again, formed integrally with the housing to extend up to the end of the housing, and an elevation is formed at the end of the snap-in nose that is associated to the housing.

The snap-in sections 20, 22, 24, 25 allow an arrangement of several adapter housings 11, 16, 17 on top of each other, wherein corresponding snap-in sections are embodied also on the bottom sides of the housings.

Two additional recesses are formed in the area of the bottom sides of the adapter housings 11, into which corresponding fixing straps of the adapters, of the fixing elements of the handles can be inserted.

As can be seen from FIGS. 2 and 3, the adapter housings 11 are arranged on the plug housing in such a way that the plug-in projection 18 extends beyond the housing into the area of the plug-in projection 13. In a like manner, the receiving portion 23 of the adapter housing 17 projects over the socket outlet housing, whereby a snap-in nose is provided on the housing parallel to the plug-in projection 18 to secure the adapter 11 to the handle.

Figure 5:
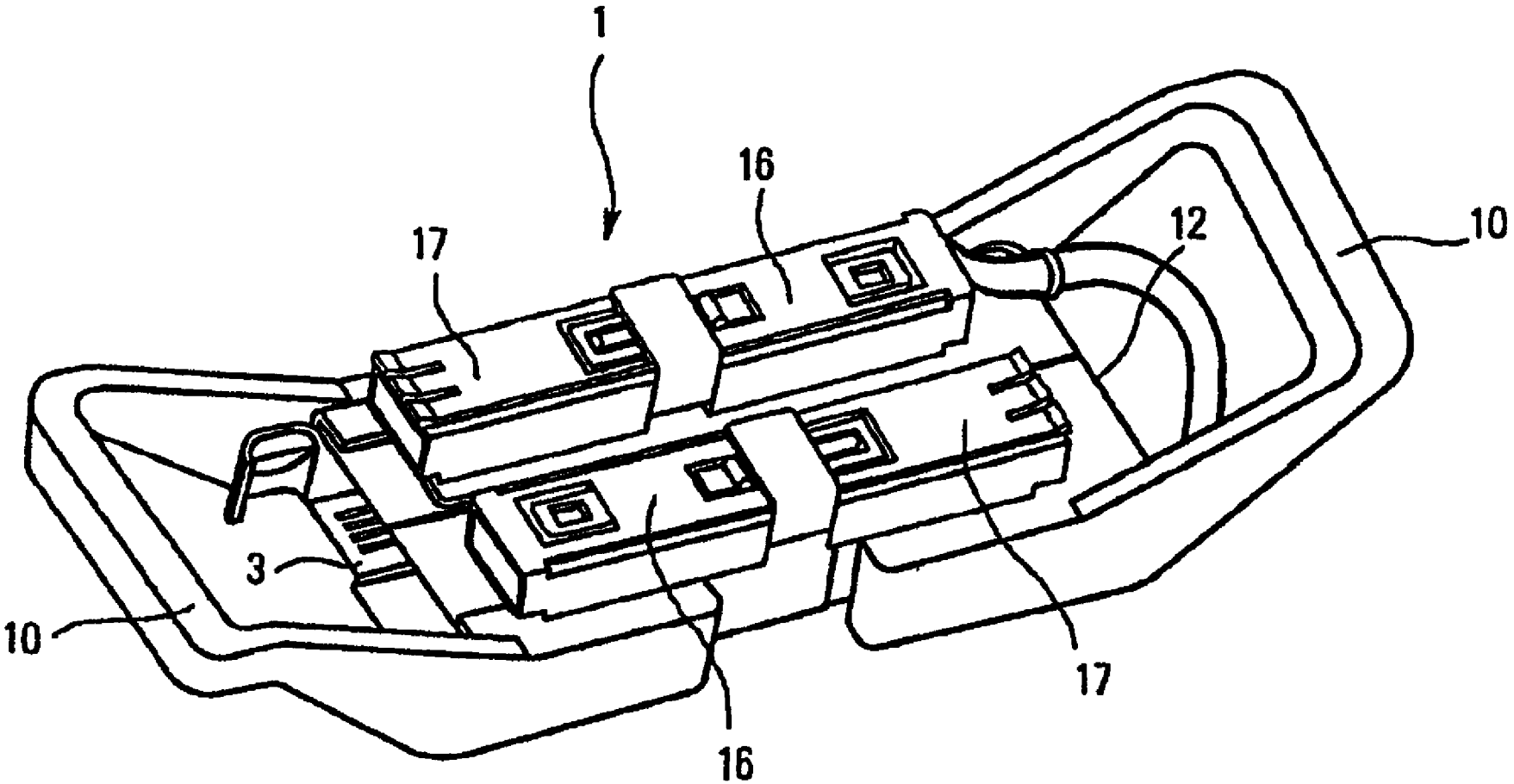
FIG. 5 shows a perspective top view onto the assembled plug housing and the socket outlet housing of FIG. 1 and FIG. 2 with connected adapter housings arranged on the same.

FIG. 5 illustrates the assembled state of the charging connector 1, comprised of a socket outlet housing 3 and a plug housing 12 with adapter housings 16 and 17 arranged thereon. It can be seen that the plug-in axis of the adapter housings extends parallel to the plug-in axis of the plug and the socket outlet.

In use, the receiving adapter is preferably inserted into the plug-in adapter housing and the plug-in adapter into the receiving adapter housing.

Figure 6:
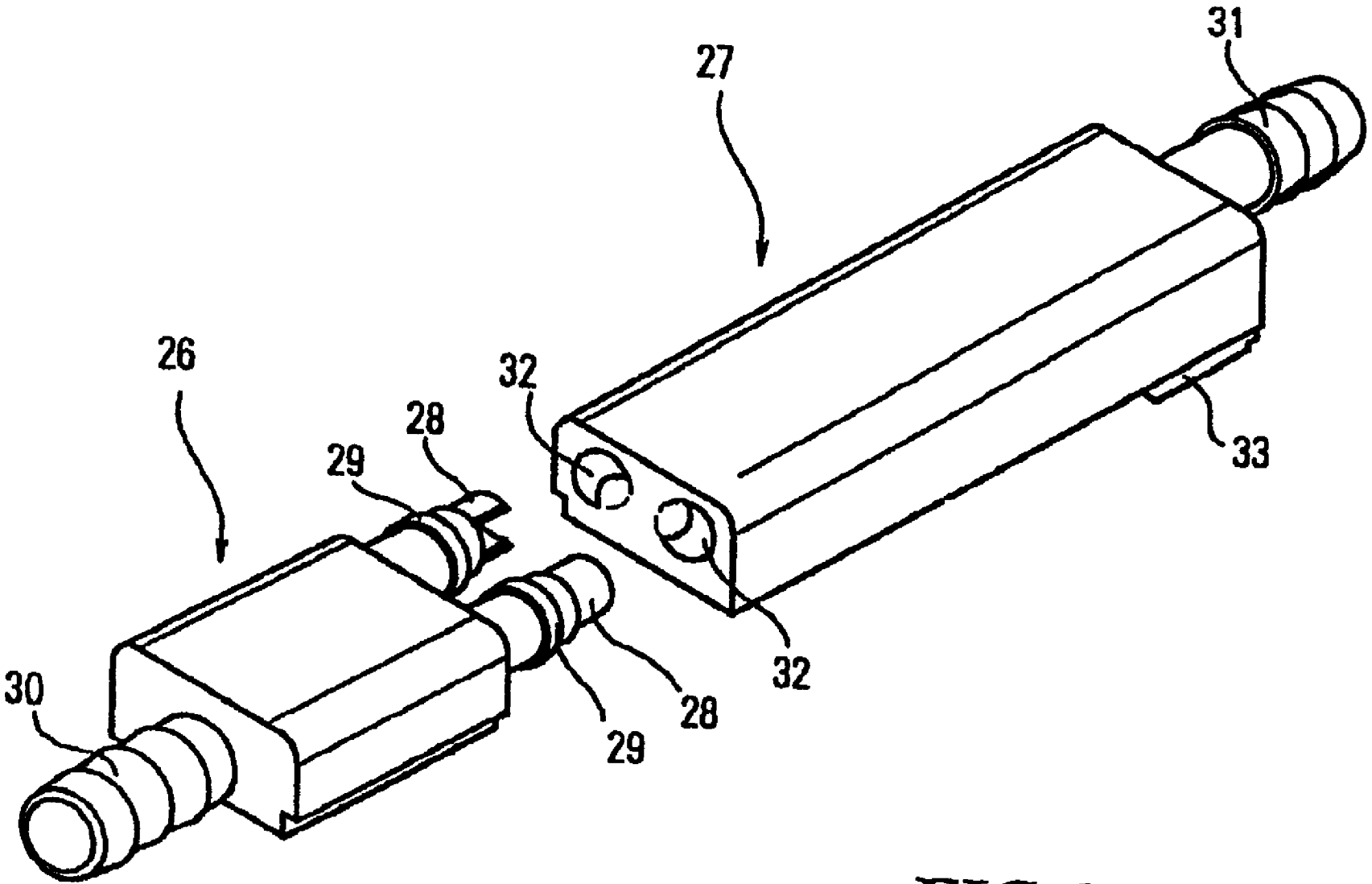
FIG. 6 shows a perspective top view onto a plug-in adapter and a receiving adapter.

FIG. 6 shows the two elements of the adapter, the plug-in adapter 26 and the receiving adapter 27. The plug-in adapter 26 comprises in its interior two fluid branch channels and one fluid main channel, which are not shown. The fluid branch channels extend in the plug-in projections 28. To obtain a tight connection in the assembled state, the plug-in projections 28 are each provided with radial grooves into which sealing rings 29 are fitted. At the end of the plug-in adapter opposite to the plug-in projections 28 another plug-in projection 30 is formed in which the fluid main channel is ending. The bottom side of the plug-in adapter 26 is formed as a fixing strap, that is, the region of the side surfaces immediately joining the bottom side is constricted. This ensures a reliable, flush contact inside the adapter housing.

Also the receiving adapter 27 is provided with fluid branch channels ending in a fluid main channel. The fluid main channel 8 ends here in a plug-in projection 31 formed on the side opposite to the plug-in adapter. The fluid branch channels 32, into which the plug-in projections 28 of the plug-in adapter 26 are introduced, extend in the side opposite to the plug-in adapter.

Also the receiving adapter 27 has a fixing strap 33 on its bottom side, by means of which the receiving adapter 27 can firmly be secured inside the adapter housing 11.

In use, first the plug-in adapter 26 and the receiving adapter 27 are inserted into the associated adapter housings 16, 17, and the adapter housings are fixed to the handle. The handle can here be embodied such that the adapters can be latched onto the handle.

Upon fixing the handle to the plug housing 12 and the socket outlet housing 3, the plug 9 and the socket outlet 2 are plugged together so that the pin contacts 5 are inserted into the pin contact recesses 14 and permit a transfer of current. At the same time, the receiving adapter housing 16 is connected to the plug adapter housing 17 and the plug-in adapter 26 to the receiving adapter 27 located in this housing. Thus, a fluid-tight coupling is created between the receiving adapter and the plug-in adapter. Fluid is consequently passed from the receiving adapter 27 through the fluid main channel and the fluid branch channels of the receiving adapter 27 into the fluid branch channels and then into the fluid main channel of the plug-in adapter 26, or vice versa.

The invention claimed is:

1. A charging connector, comprising a plug provided with a plug housing and a socket outlet provided with a socket outlet housing, the plug housing and the socket outlet housing each having fixing means for fixing a handle in an interchangeable manner, the charging connector being provided with interchangeable adapters for fluid lines and/or pilot contacts, wherein the adapters are arranged on the interchangeable handles and can be fixed therewith to the plug housing and/or socket outlet housing.

2. The charging connector according to claim 1, wherein each adapter is received in an adapter housing to which the adapter is detachably connectable.

3. The charging connector according to claim 2, wherein the adapter housing has two parts, wherein one part is associated to the plug housing and one part to the socket outlet housing.

4. The charging connector according to claim 1 or 2, wherein the adapter housing can be locked into place on the handle.

5. The charging connector according to claim 1, wherein the handle associated to the plug housing as well as the handle associated to the socket outlet housing are provided with at least one adapter housing.

6. The charging connector according to claim 5, wherein each adapter housing comprises a receiving portion or a plug-in portion, wherein an adapter housing comprising a plug-in portion is associated to an adapter housing comprising a receiving portion.

7. The charging connector according to claim 5 or 5, wherein the adapter housing has a substantially rectangular cross-section.

8. The charging connector according to claim 5, wherein at least two adapter housings are arranged on one another.

9. The charging connector according to claim 5, wherein snap-in-elements are formed on an outer topside and/or an outer bottom side of the adapter housing.

10. The charging connector according to claim 5, wherein an outer top surface of each adapter housing has a snap-in nose and a snap-in cavity formed on opposite ends.

11. The charging connector according to claim 5, wherein a bottom side of the housing of each adapter comprises a recess in which a fixing strap of an adapter or of the handle can be received.

* * * * *

UNITED STATES PATENT AND TRADEMARK OFFICE

CERTIFICATE OF CORRECTION

PATENT NO. : 7,686,634 B2
APPLICATION NO. : 11/994900
DATED : March 30, 2010
INVENTOR(S) : Jens Trimborn et al.

It is certified that error appears in the above-identified patent and that said Letters Patent is hereby corrected as shown below:

In claim 7, column 8, line 1, "claim 5 or 5," should read --claim 3 or 5,--.

Signed and Sealed this
First Day of January, 2013

David J. Kappos

David J. Kappos
*Director of the United States Patent and Trademark Office*